US008203511B2

(12) United States Patent
Shikina

(10) Patent No.: US 8,203,511 B2
(45) Date of Patent: Jun. 19, 2012

(54) DISPLAY APPARATUS

(75) Inventor: Noriyuki Shikina, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 873 days.

(21) Appl. No.: 12/042,632

(22) Filed: Mar. 5, 2008

(65) Prior Publication Data

US 2009/0027309 A1 Jan. 29, 2009

(30) Foreign Application Priority Data

Mar. 9, 2007 (JP) ..... 2007-060278

(51) Int. Cl.
*G09G 3/30* (2006.01)

(52) U.S. Cl. ..... 345/77; 345/83

(58) Field of Classification Search ..... 345/76–77, 345/82–83

See application file for complete search history.

(56) References Cited

U.S. PATENT DOCUMENTS

| | | | | |
|---|---|---|---|---|
| 6,373,454 | B1 | 4/2002 | Knapp et al. | |
| 7,573,445 | B2 | 8/2009 | Machida | |
| 2001/0022565 | A1* | 9/2001 | Kimura | 345/82 |
| 2004/0155841 | A1* | 8/2004 | Kasai | 345/76 |
| 2006/0092107 | A1* | 5/2006 | Kim | 345/76 |
| 2006/0158394 | A1* | 7/2006 | Choi | 345/76 |
| 2006/0187185 | A1 | 8/2006 | Yoshinaga et al. | 345/107 |
| 2007/0133080 | A1 | 6/2007 | Shikina et al. | 359/296 |

FOREIGN PATENT DOCUMENTS

| | | |
|---|---|---|
| JP | 2006-053236 | 2/2006 |
| WO | 2004/057561 A1 | 7/2004 |

* cited by examiner

*Primary Examiner* — Chanh Nguyen
*Assistant Examiner* — Tsegaye Seyoum
(74) *Attorney, Agent, or Firm* — Fitzpatrick, Cella, Harper & Scinto

(57) ABSTRACT

A display apparatus includes a plurality of pixel circuits arranged in a matrix form, each including a light emitting device, a plurality of information lines, an information line drive circuit, and a plurality of scanning lines. In addition, a scanning line drive circuit sequentially supplies scanning signals to the plurality of scanning lines in one vertical period, a plurality of on-and-off control lines control turning-on and turning-off of the light emitting devices in a row of the matrix form, and an on-and-off control line drive circuit supplies on-and-off control signals to the plurality of on-and-off control lines. In each vertical period, the information line drive circuit and the scanning line drive circuit supply the information signal once to each of the pixel circuits, wherein the pixel circuit supplies a current corresponding to the supplied information signal to the light emitting device, and wherein the on-and-off control line drive circuit supplies composite signals each provided by synthesizing a first signal and a second signal to the respective on-and-off control lines as on-and-off control signals. The first signal has a frequency corresponding to the vertical period, and the second signal has a frequency twice or more as large as that of the first signal.

4 Claims, 16 Drawing Sheets

RELATION BETWEEN LIGHT-EMITTING STATE OF MOVING IMAGE, TIME AXIS AND VIEW

RELATION BETWEEN LIGHT-EMITTING STATE OF MOVING IMAGE, TIME AXIS AND VIEW

DISPLAY APPARATUS

BACKGROUND OF THE INVENTION

1. Field of the Invention

The present invention relates to a display apparatus using light emitting devices, such as organic EL (electro-luminescence) devices, and more particularly to a drive method of the light emitting devices.

2. Related Background Art

In a flat display panel including organic EL devices or the like, pixels arranged in a plurality of rows and in a plurality of columns are commonly connected to a scanning line on a row basis and to a data line on a column basis, and each scanning line is selected by a row scanning circuit. At the same time, a column scanning circuit applies a predetermined display signal to each data line to make the pixels on the selected row perform a predetermined display. Such matrix driving is generally performed. As to the matrix driving, U.S. Pat. No. 6,373,454 discloses an EL display panel using active matrix driving.

A display panel including the organic EL devices can adjust the emission intensity of each pixel by controlling the current flowing through the organic EL device in the pixel.

FIG. 12 is a block diagram illustrating the schematic configuration of an active matrix type display panel of related art. In this figure, the display panel includes a current setting circuit 201, a scanning line drive circuit 202, and pixel circuits 203 arranged in a matrix.

FIG. 13 illustrates a configuration example of a related-art pixel circuit including an organic EL device. The pixel circuit includes scanning lines P1 and P2, and an information line P0. Current data Idata is input from the information line P0 as an information signal. The anode of the organic EL device is connected to the drain terminal of a TFT M4, and the cathode of the organic EL device is connected to the ground potential CGND. Transistors M1, M2, and M4 are P type TFTs, and a transistor M3 is an N type TFT.

The outline of the operation of the pixel circuit is next described. When the current data Idata is input, a high level (hereinafter referred to as an HI level) signal is input into the scanning line P1, and a low level (hereinafter referred to as a LOW level) signal is input to the scanning line P2. The transistors M2 and M3 are turned on, and the transistor M4 is turned off. At this time, because the transistor M4 is not in its conductive state, no current flows through the organic EL device. A voltage corresponding to the current drive performance of the transistor M1 is generated in a capacitor C1 disposed between the gate terminal of the transistor M1 and power potential V1 due to the current data Idata.

When a current is supplied to the organic EL device, a LOW level signal is input into the scanning line P1, and an HI level signal is input into the scanning line P2. At this time, the transistor M4 is turned on, and the transistors M2 and M3 are turned off. Because the transistor M4 is in its conductive state, a current corresponding to the current drive performance of the transistor M1 is supplied to the organic EL device due to the voltage generated in the capacitor C1. The organic EL device emits a light of the brightness according to the supplied current.

By the way, it is difficult to adjust the brightness of the display panel using such organic EL devices. In the case of a liquid crystal display panel, the only thing required for the liquid crystal display panel is to adjust the brightness of the back light thereof, and consequently the liquid crystal display panel can relatively easily adjust the brightness of the display panel without changing the image quality level thereof.

On the other hand, in the case of the organic EL device, because the brightness thereof is controlled by the quantity of a current flowing through each pixel, it is necessary to control the whole display panel in a low current region in order to darken the whole display panel. The deterioration of the image quality of the display panel is caused owing to the use of the low current region, the controllability of which is bad.

Accordingly, there is a technique of controlling the light-emitting period of the organic EL device in order to adjust the brightness of the whole display panel. However, there is a problem of the occurrence of a flicker in the case where a non-luminous time zone occupies 10-30% or more of a period in one field. This flicker appears to have the tendency of becoming easy to observe when a black (non-luminous) band moving on a screen during a non-luminous period is wide.

Moreover, there is a technique of narrowing the black band generated in the non-luminous period in order to cope with both the brightness adjustment and the flicker decreasing. That is, this technique increases the on-and-off rate of light emitting, keeping a rate of an image data writing into pixel circuits fixed (for example, 60 Hz). The technique is disclosed in Japanese Patent Application Laid-Open No. 2006-053236.

By the aforesaid (high frequency on-and-off type) method of increasing the on-and-off rate of light emitting while fixing the rate of the image data writing into the pixel circuits, for example, at 60 Hz, the visibility of a display panel is the same as that of a hold type display panel. In this case, there is a problem of the lowering of the resolution of a moving image as compared with that of an impulse type display panel.

FIGS. 14A and 14B illustrate a display state of a moving image, and an apparent image, of an impulse type display panel, respectively. FIGS. 15A and 15B illustrate a display state of a moving image, and an apparent image, of a hold type display panel, respectively. FIGS. 16A and 16B illustrate a display state of a moving image, and an apparent image, of a high frequency on-and-off type display panel, respectively. FIGS. 14A, 15A, and 16A each illustrate relations between light-emitting states of a moving image, a time axis and views. Their abscissa axes each indicate the positions of pixels, and their ordinate axes each indicate times (fields). The bold line arrows illustrate motions of viewpoints.

FIGS. 14B, 15B, and 16B illustrate apparent images. Their abscissa axes each indicate relative positions of appeared images, and their ordinate axes each indicate brightness. The positions a-j illustrated in FIGS. 14B, 15B, and 16B correspond to the positions a-j illustrated in FIGS. 14A, 15A, and 16A, respectively. It is expressed that the edges of the images are seen more conspicuous as the inclinations of the lines in FIGS. 14B, 15B, and 16B become steeper. Moreover, it is expressed that the edges of the images are seen to be more blurred as the inclinations of the lines in FIGS. 14B, 15B, and 16B become gentler.

As illustrated in FIGS. 14A, 15A, and 16A, it is found that a viewpoint also continuously moves, following the movement of an object when the object moves on a screen. At that time, the apparent brightness that is recognized as visual information is an integrated quantity of the brightness at each position in the field of vision.

Consequently, as shown in FIG. 14B, an edge is seen to be conspicuous on an impulse type display panel, and an edge is seen to be blurred on a hold type or a high frequency on-and-off type display panel as shown in FIG. 15B or 16B, respectively, on the other hand. Consequently, it has been a subject to decrease the flicker with the resolution of a moving image heightened.

SUMMARY OF THE INVENTION

It is an aspect of the present invention to provide a display apparatus capable of decreasing a flicker and reducing the color breakup at the edge portion of a moving image with the resolution of the moving image heightened.

A display apparatus of the present invention including: a plurality of pixel circuits arranged in a matrix form, each including a light emitting device; a plurality of information lines, each connecting the pixel circuits in a column of the matrix form; an information line drive circuit, which supplies information signals to the plurality of information lines; a plurality of scanning lines, each connecting the pixel circuits in a row of the matrix form; a scanning line drive circuit, which sequentially supplies scanning signals to the plurality of scanning lines in one vertical period; a plurality of on-and-off control lines, each controlling turning-on and turning-off of the light emitting devices in a row of the matrix form; and an on-and-off control line drive circuit, which supplies on-and-off control signals to the plurality of on-and-off control lines, wherein each of the on-and-off control signals is a composite signal of a first signal having a frequency corresponding to the vertical period, and a second signal having a frequency being twice or more as large as that of the first signal.

According to the present invention, the edge of a moving image is conspicuously seen at the time of a moving image display, and enables the decrease of a flicker with the resolution of the moving image being heightened. Moreover, the color breakup on the edge portion of a moving image can be suppressed with keeping white balance, and a uniform image quality in a panel surface can be further obtained.

Further features of the present invention will become apparent from the following description of exemplary embodiments with reference to the attached drawings.

DETAILED DESCRIPTION OF THE INVENTION

The exemplary embodiments of the present invention will be described in detail with reference to the attached drawings. The present invention can be suitably applied to an active matrix type display panel using organic EL devices particularly.

In the present invention, a pixel including a light emitting device (for example, an organic EL device) especially includes a switching device for cutting off a current to the organic EL device. The present invention selectively controls on and off of light emission of the organic EL device by using the switching device regardless of a value of an information signal. The control signal at that time is a composite signal of a signal A having the same frequency as that of a vertical synchronizing signal and a signal B having a frequency being twice or more as large as that of the vertical synchronizing signal. The organic EL device is driven to be turned on and off by using the composite signal.

First Embodiment

Figure 1:
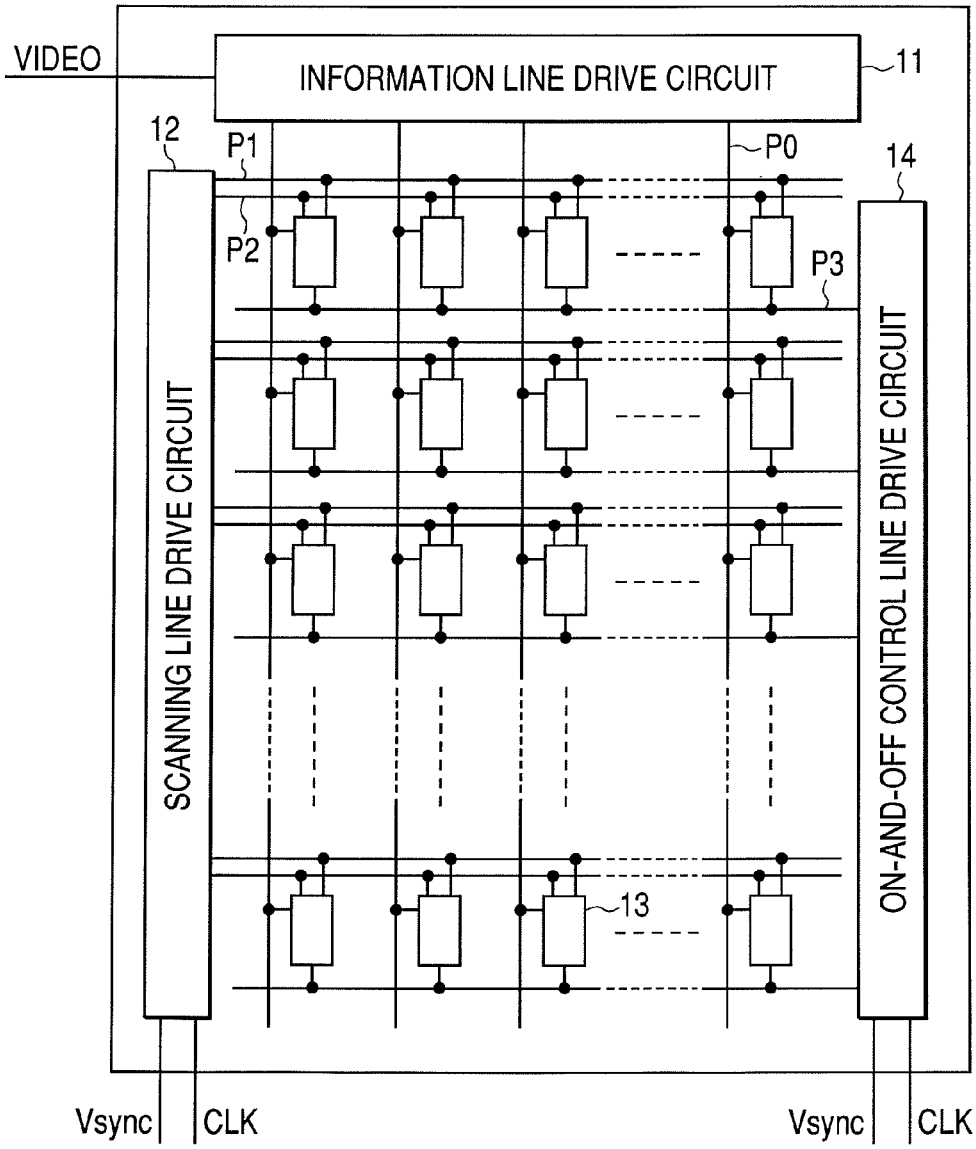
FIG. 1 is a block diagram illustrating a display apparatus according to a first embodiment of the present invention.

FIG. 1 is a block diagram illustrating a first embodiment of a display apparatus according to the present invention. The display apparatus of the present embodiment includes pixel circuits (pixels) 13 arranged in a matrix form, thereby providing a display region. Each of the pixel circuits 13 includes an organic EL device, which is a light emitting device.

The pixel circuits 13 are connected to scanning lines P1 and P2 in row direction, and are connected to information lines P0 in column direction. An information line drive circuit 11 supplies control current Idata or control voltage Vdata, both being information signals, to the pixel circuits 13 arranged in a matrix through the information lines P0.

When a vertical synchronizing signal Vsync and a clock signal CLK are input into a scanning line drive circuit 12 from the outside, a shift register (denoted by SR in FIGS. 4A and 4B described below) in the scanning line drive circuit 12 is activated. The scanning line drive circuit 12 then supplies horizontal synchronizing signals, each of which indicates one horizontal period, to the pixel circuits 13, arranged in a matrix form, through the first scanning lines P1 and the second scanning lines P2. The horizontal synchronizing signals are sequentially supplied to each row, and the supply thereof is stopped when the horizontal synchronizing signals have been supplied to all the rows. After that, the next vertical synchronizing signal is input, so that the same operation is repeated.

An on-and-off control line drive circuit 14 supplies on-and-off control signals to each of the pixel circuits 13 arranged in a matrix form, through on-and-off control lines P3, and thereby drives the organic EL device in the pixel circuit 13 to be turned on and off. The pixel circuit 13 controls the current to be flown to the pixel according to the values of control current Idata. Each of the pixel circuits 13 includes an organic EL device, its drive circuit and the like.

Figure 2:
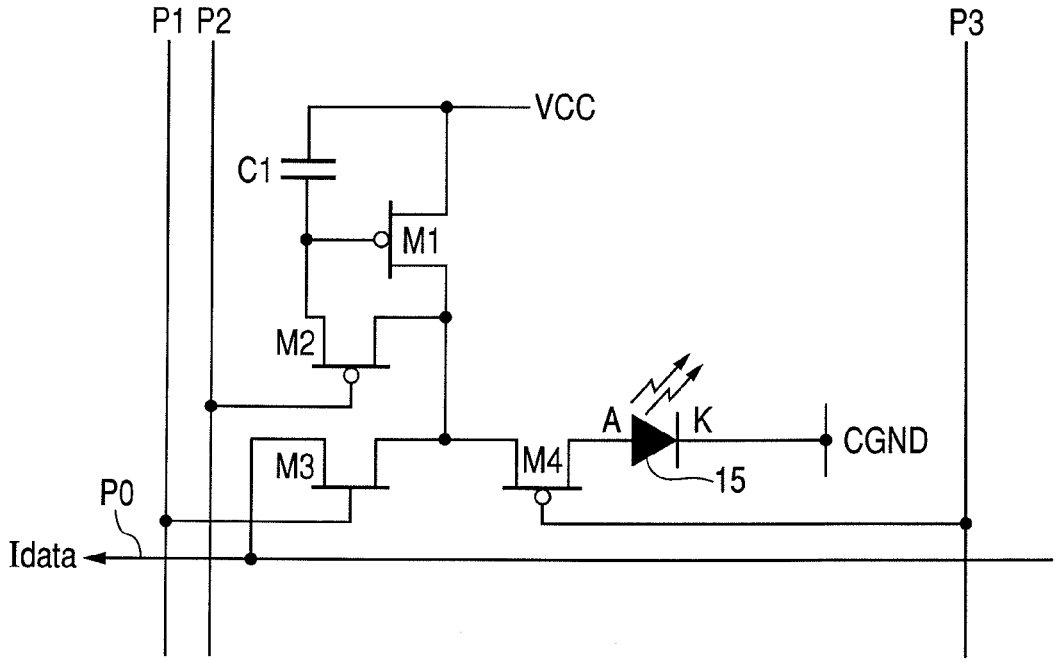
FIG. 2 is a circuit diagram illustrating an example of a pixel circuit of the first embodiment.

A configuration example of each of the pixel circuits 13 including an organic EL device is illustrated in FIG. 2. FIG. 2 illustrates an example of a current programming type pixel circuit. The pixel circuit includes an information line P0 and scanning lines P1 and P2. The scanning line P1 is a first scanning line, and the scanning line P2 is a second scanning line. The pixel circuit further includes an on-and-off control line P3. Current data Idata is supplied from the information line drive circuit 11 to the information line P0 as an information signal. The pixel circuit still further includes an organic EL device 15 used as a light emitting device.

The anode A of the organic EL device 15 is connected to the drain terminal of a thin film transistor (TFT) M4, and the cathode K of the organic EL device 15 is connected to the ground potential CGND. The pixel circuit includes P type TFTs M1, M2, and M4, an N type TFT M3, and a capacitor C1.

Next, the operation of the pixel circuit 13 is described. First, when the current data Idata is input into the information line P0 from the information line drive circuit 11, a HI level signal is input into the scanning line P1; a LOW level signal is input into the scanning line P2; and a HI level signal is input into the on-and-off control line P3. At this time, the transistors M2 and M3 are turned on, and the transistor M4 is turned off.

Moreover, because the transistor M4 is not in its conductive state in that case, no current flows through the organic EL device 15. At that time, a voltage corresponding to the current drive performance of the transistor M1 is generated at the capacitor C1, connected between the gate terminal of the transistor M1 and power potential Vcc, due to the control current Idata.

When a current is supplied to the organic EL device 15, a LOW level signal is input into the scanning line P1; a HI level signal is input into the scanning line P2; and a LOW level signal is input into the on-and-off control line P3. At this time, the transistor M4 is turned on, and the transistors M2 and M3 are turned off. At this time, because the transistor M4 is in its conductive state, a current corresponding to the current drive performance of the transistor M1 is supplied to the organic EL device 15 due to the voltage generated on the capacitor C1, and the organic EL device 15 emits a light of the brightness according to the supplied current.

Moreover, when the current flowing through the organic EL device 15 is cut off, a LOW level signal is input into the scanning line P1; a HI level signal is input into the scanning line P2; and a HI level signal is input into the on-and-off control line P3. At this time, the transistors M4, M2, and M3 are tuned off. In this case, because the transistor M4 is in its non-conductive state, the current supply to the organic EL device 15 is cut off, and the organic EL device 15 can be made to be a non-luminous state. The light emitting period of the organic EL device 15 can be arbitrarily controlled by switching the level of the signal applied to the on-and-off control line P3 between the HI level and the LOW level in the aforesaid way.

Incidentally, although the configuration of FIG. 2 is cited as an example of the pixel circuit 13, the configuration of the pixel circuit 13 of the present invention is not limited to this configuration. That is, although the current programming type pixel circuit is exemplified, a voltage programming type circuit and the like may be used.

Figure 3:
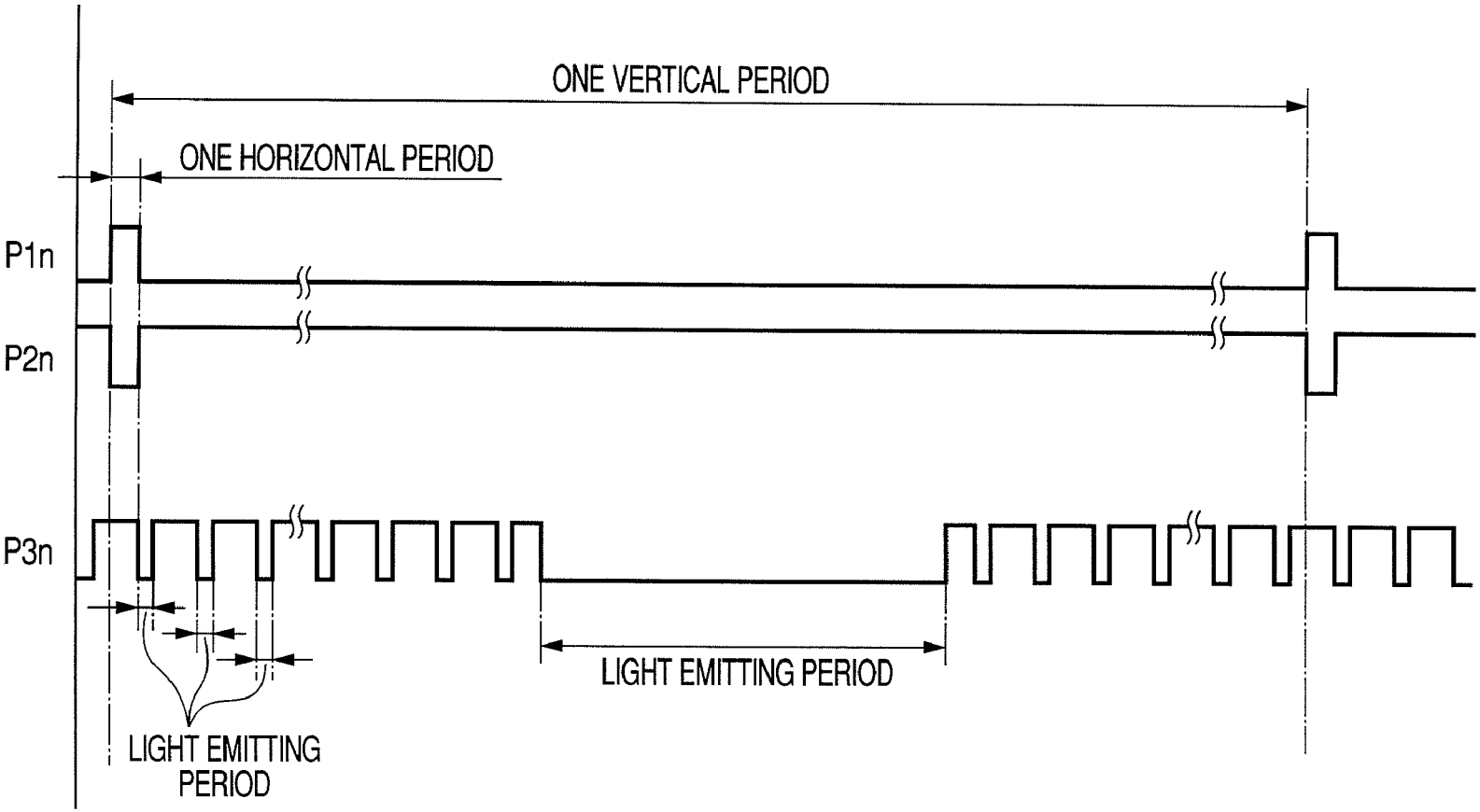
FIG. 3 is a signal waveform diagram illustrating a signal waveform and a light-emitting state of each portion of the first embodiment.

Next, the operation of the whole display apparatus is described. FIG. 3 illustrates a timing chart of each signal line. Information currents are written into a pixel group connected to one scanning line in a lump during one horizontal period in the present embodiment.

Similarly, the information currents are sequentially written into the pixel group connected to the scanning line on the next row in a lump, and the writing of the information currents into all of the pixels is completed during one vertical period (16.67 msec: equivalent to 60 Hz).

Signals to scanning lines P1*n* and P2*n* in FIG. 3 denote scanning signals applied to the scanning lines P1*n* and P2*n* at the nth row from the scanning line drive circuit 11. A signal to an on-and-off control line P3*n* denote an on-and-off control signal to the nth row from the on-and-off control line P3. The writing into the nth row of the display panel is performed when the scanning line P1*n* is the HI level, the scanning line P2*n* is the LOW level, and the on-and-off control line P3*n* is the HI level, and information is stored in the pixel circuit 13 according to the current data Idata input from the information line P0. After that, the scanning line P1*n* is turned to the LOW level, and the scanning line P2*n* is turned to the HI level. The pixel is then in the state in which a current can be flown through the organic EL device 15 in accordance with the stored information.

During the period in which the on-and-off control line P3*n* is in the LOW level, a current flows through the organic EL device 15 in accordance with the stored information, and the organic EL device 15 becomes the light-emitting state. Furthermore, when the on-and-off control line P3*n* is turned to the HI level, the current supply to the organic EL device 15 is cut off, and then the organic EL device 15 becomes a non-luminous state.

Next, a signal Cn, which the on-and-off control line drive circuit 14 outputs to the on-and-off control line P3*n*, will be described.

Figure 4A:
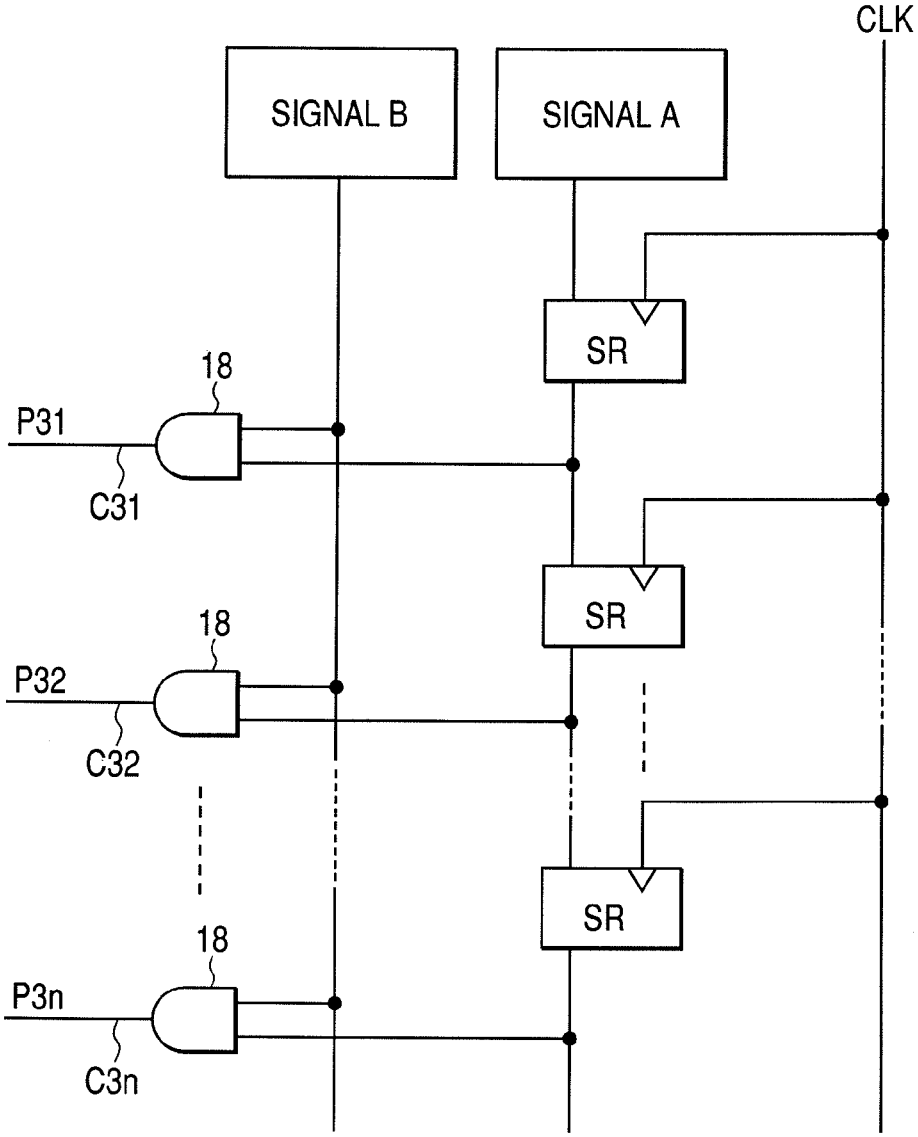
FIGS. 4A and 4B are circuit diagrams illustrating examples of an on-and-off control line drive circuit of the first embodiment.
Figure 4B:
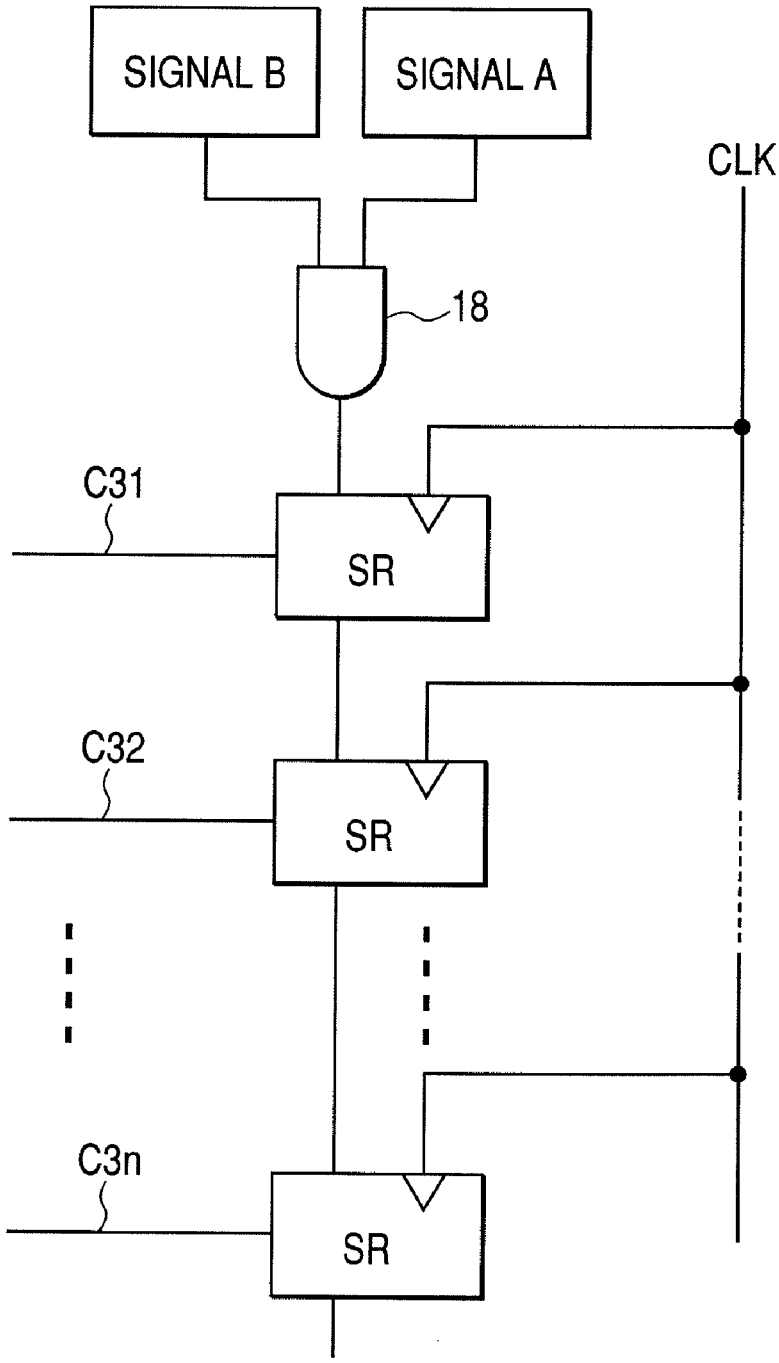
Figure 5:
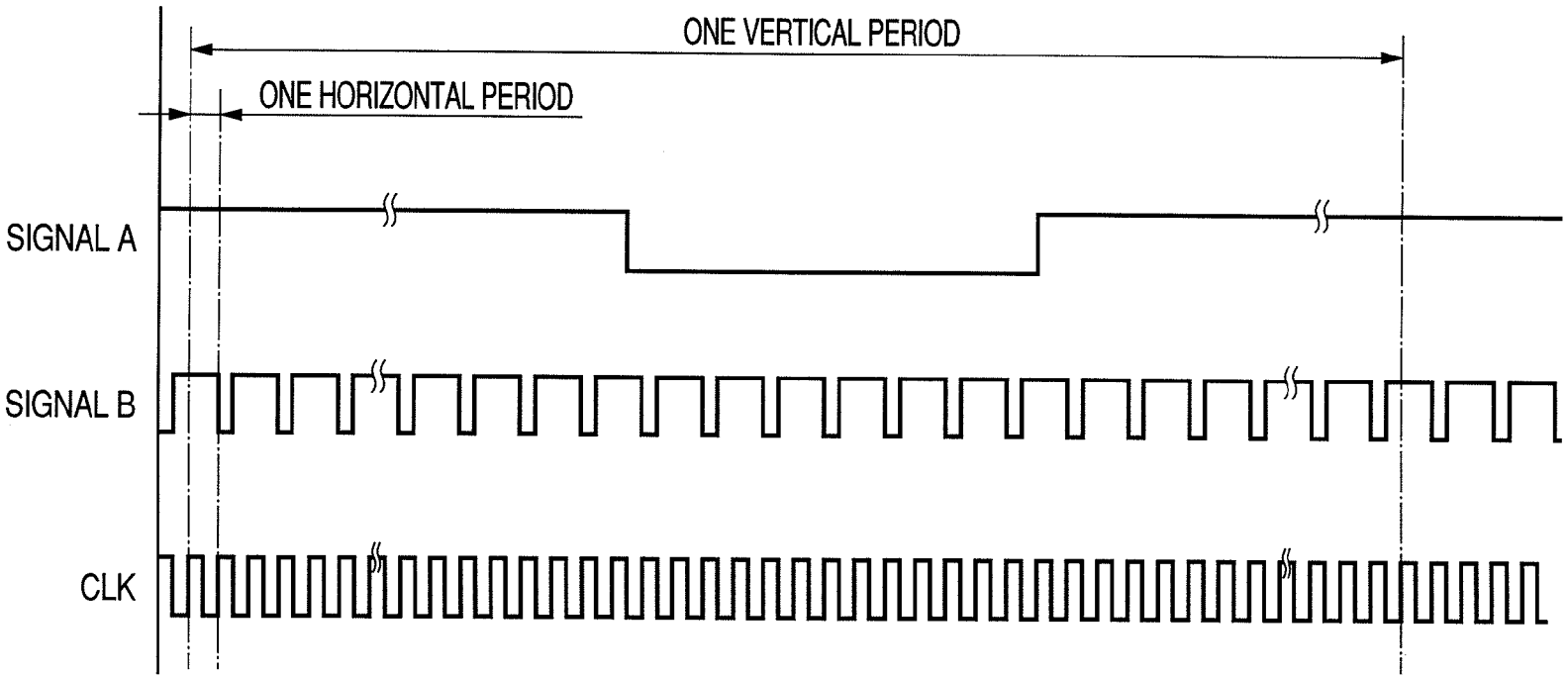
FIG. 5 is a diagram illustrating a signal of each portion of the on-and-off control line drive circuit of FIGS. 4A and 4B.

FIG. 4A is a block diagram illustrating an example of the on-and-off control line drive circuit 14, and FIG. 5 is a signal waveform diagram illustrating the signal of each portion of the on-and-off control line drive circuit 14. A signal A, which is a first signal, and a signal B, which is a second signal, are supposed to be transmitted from a not-illustrated external signal generating circuit to the on-and-off control line drive circuit 14. The signal A is synchronized with the vertical synchronizing signal, and has the same frequency as that of one vertical period (the inverse number of the one vertical period; 60 Hz in this case). The signal B is a signal having the frequency of being integer times of the vertical synchronizing signal. In order to decrease a flicker, it is better to set the frequency of the signal B to be twice or more as large as that of the signal A. In the case of FIG. 5, the frequency of the signal B is set at 1,200 Hz, which is 20 times of that of the signal A.

The signal B is output to one input terminal of each of the AND gates 18 as it is, and the signal A is output into the other input terminal of each of the AND gate 18 through a shift register SR. The clock signal CLK of FIG. 5 is supplied to the shift register SR. The clock signal CLK is set to have a frequency being twice or more as much as that of the signal B. As a result, the first signal A is output from the respective stages of the shift register SR at different timing in each row, and the first signal A is synthesized with the second signal B in the AND gates 18. The composite signal C is output from the AND gates 18.

That is, as illustrated in FIG. 4A, composite signals C31, C32, . . . , and C3*n* are output from the AND gates 18, and the levels of those composite signals C31, C32, . . . , and C3*n* are shifted by not-illustrated buffer circuits. Thereby the on-and-off control signals are formed to be output to the on-and-off control lines of the respective rows in order. The on-and-off control signal illustrated in FIG. 3 (the signal to the on-and-off control line P3*n*) is the signal illustrating the above-mentioned on-and-off control signals in the form of time series. When the on-and-off control signals are supplied from the on-and-off control line drive circuit 14 to the respective pixel circuits through the on-and-off control lines P3 as described above, the lighting of the respective pixels by the signal A is turned on at the different timing in the respective rows, and the lighting of the respective pixels by the signal B is turned on at the timing common to all the rows.

In the circuit of FIG. 4A, both of the signals A and B are synchronized with the vertical synchronizing signal. Because the signal B is an on-and-off signal common to all of the pixel circuits, the whole body of the display apparatus is turning on and off at the frequency of the signal B while the lighting by the signal A is sequentially turned on at different timing in each row.

The signal B may be supplied at different timing in each row. What is required to realize the different timing of the signal B is only to alter the circuit of FIG. 4A to the one illustrated in FIG. 4B, so that an AND signal of the signal A and the signal B is input into the shift register SR. The signal A and the signal B are first synthesized in the AND gate 18, and the composite signal C is input into the shift register SR. The composite signal C is sequentially output from each stage of the shift register SR at the different timing in each row, and passes through a not-illustrated buffer circuit to be an on-and-off control signal. Then, the on-and-off control signal is supplied to the on-and-off control line P3*n*. Similarly to the turning on and off of the signal A, the turning on and off of the signal B takes place sequentially at the different timing for each row. In this case, because the timing of writing information into pixels and the timing of emitting light by the organic EL devices do not overlap each other, an image quality uniform in a display panel surface can be obtained.

Figure 6A:
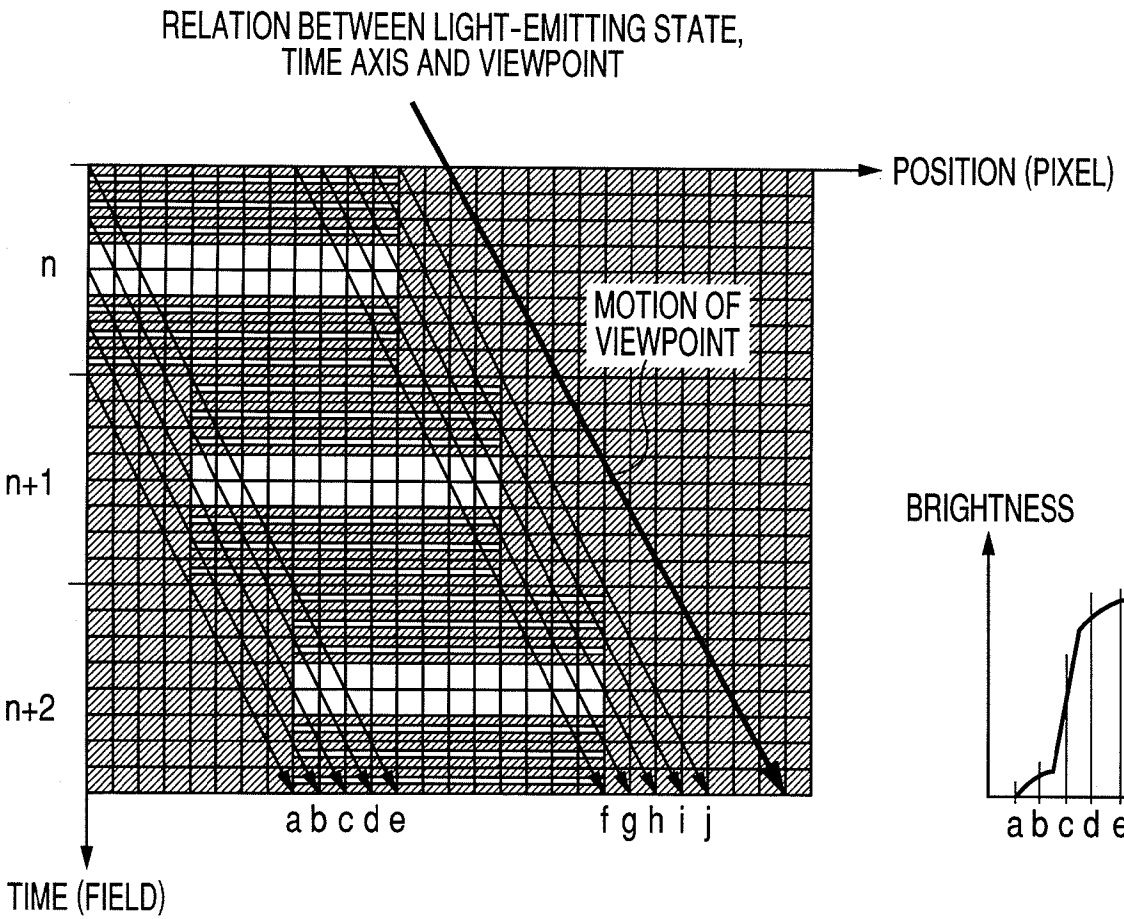
FIGS. 6A and 6B are diagrams illustrating light-emitting states and an apparent image of a moving image of the first embodiment.
Figure 6B:
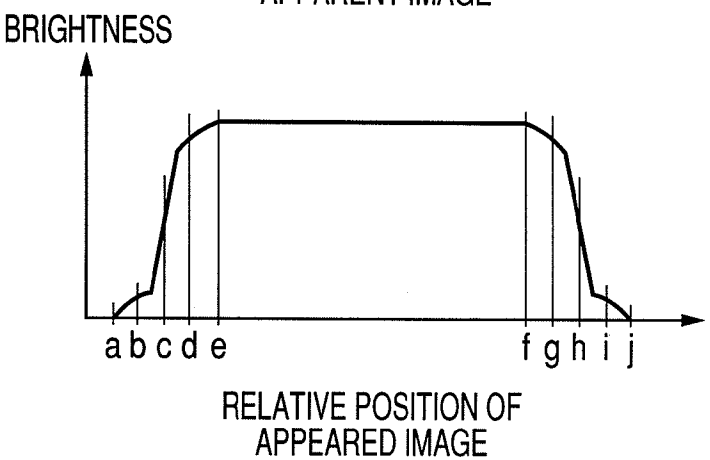

A moving image displaying state and an apparent image in the case of displaying a moving object (white object in a black background) with the display apparatus of the present embodiment are illustrated in FIGS. 6A and 6B, respectively. That is, FIG. 6A illustrates relations between light-emitting states of the moving image, a time axis, and viewpoints, and FIG. 6B illustrates the apparent image. When an object moves on a screen, a viewpoint also continuously moves, following the movement of the object. At that time, apparent brightness recognized as visual information is an integrated quantity of the brightness at each position in the field of vision.

Figure 15A:
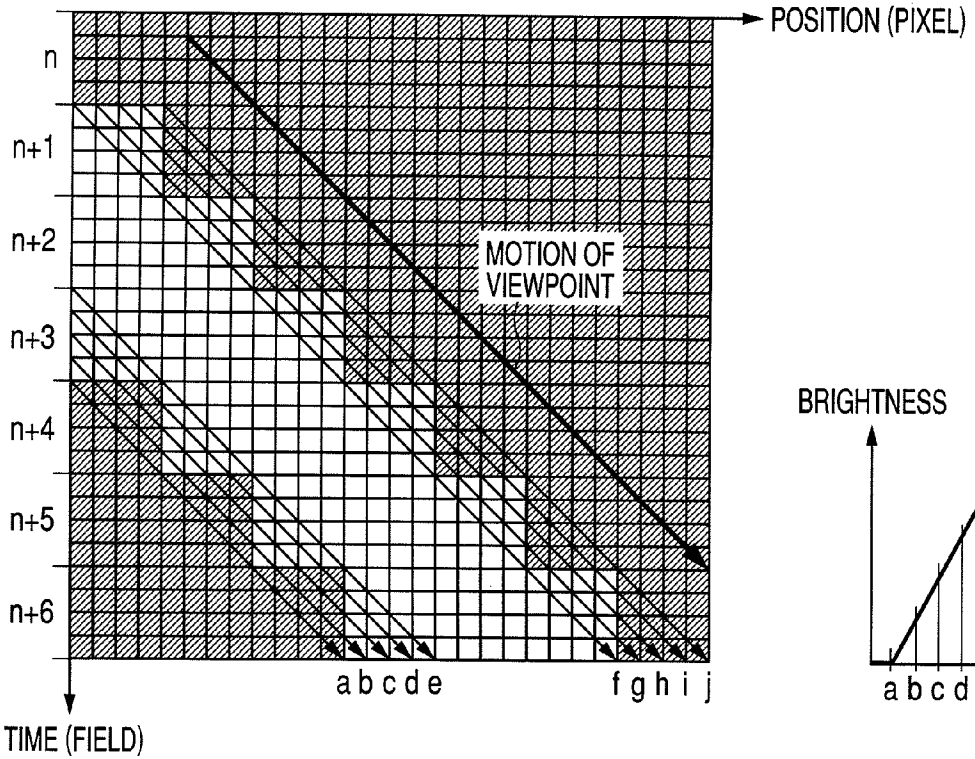
FIGS. 15A and 15B are diagrams illustrating a hold type moving image displaying state and an apparent image, respectively.
Figure 15B:
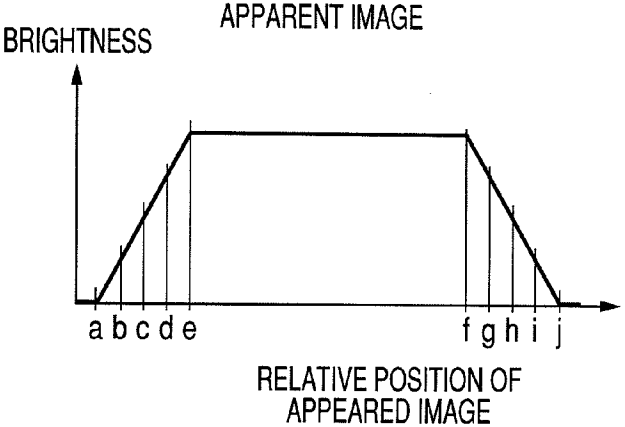
Figure 16A:
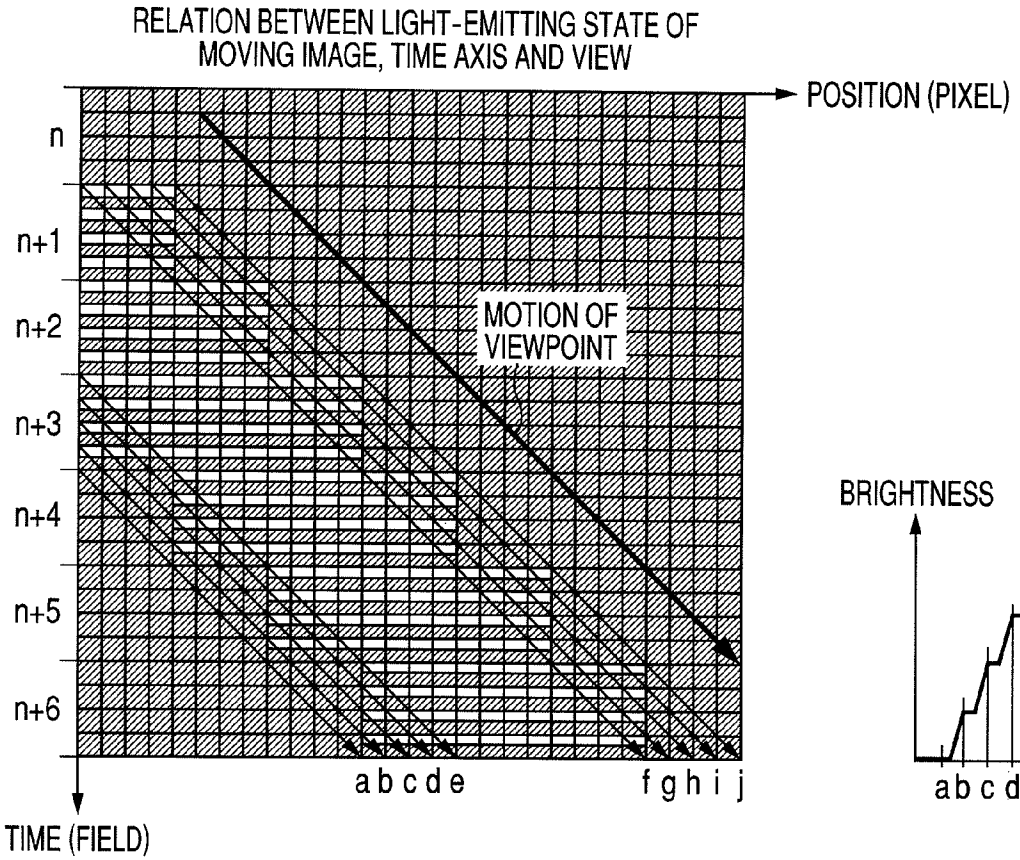
FIGS. 16A and 16B are diagrams illustrating high frequency on-and-off type moving image displaying state and an apparent image, respectively.
Figure 16B:
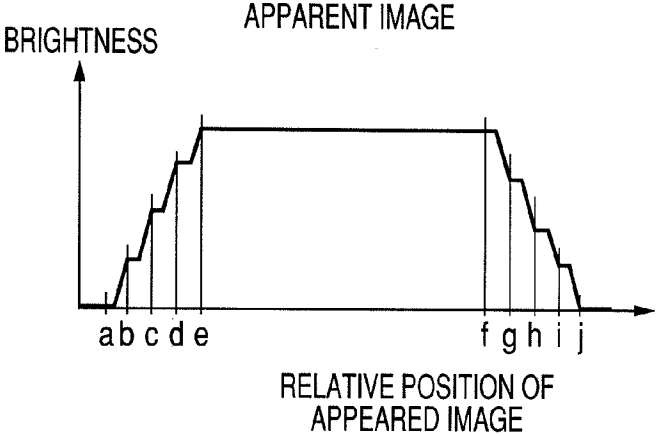

At this time, the apparent image becomes the one illustrated in FIG. 6B, so that it appears that the edge of the apparent image is seen to be conspicuous (the inclinations at rising and falling are steep) in comparison with the edge of the hold type display illustrated in FIGS. 15A and 15B and the edge of the high frequency on-and-off type display illustrated in FIGS. 16A and 16B. Moreover, because the organic EL devices are driven to be turned on and off on the basis of the high frequency signal B, the decrease of a flicker also can be attained. In the way described above, the resolution of a moving image can be heightened with a flicker being decreased.

Second Embodiment

Figure 7:
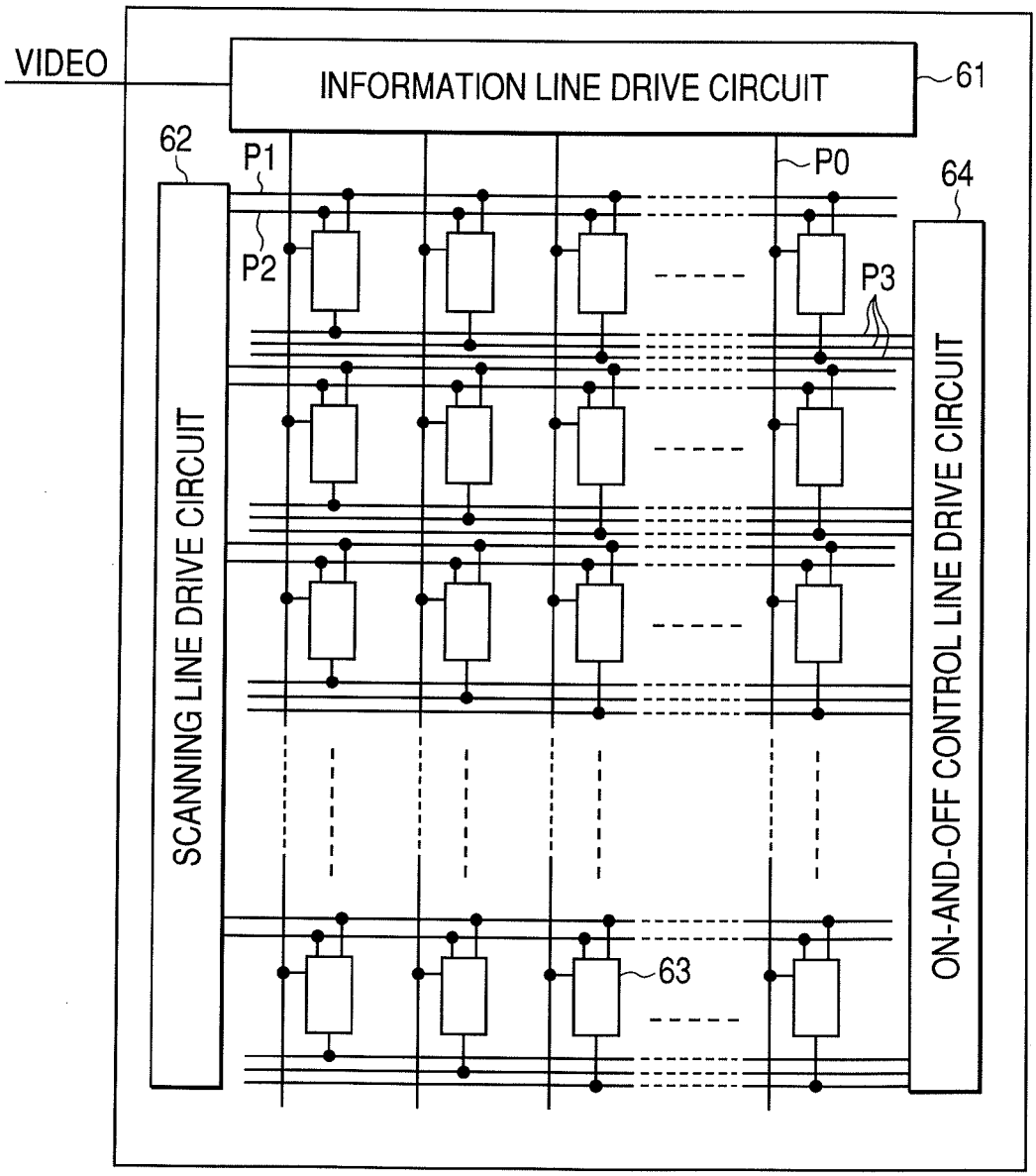
FIG. 7 is a block diagram illustrating a second embodiment of the present invention.

Next, a second embodiment of the display apparatus of the present invention will be described. The second embodiment attains the on-and-off drive control of each of a red color, a green color, and a blue color independently. FIG. 7 is a block diagram illustrating the display apparatus of the present embodiment.

The display apparatus of the present embodiment includes pixel circuits (pixels) 63 arranged in a matrix form. Moreover, the display apparatus is provided with an information line drive circuit 61 for supplying control current Idata, which is an information signal, to the pixel circuits 63 through the information lines P0. Furthermore, the display apparatus is provided with a scanning line drive circuit 62 for supplying a vertical synchronizing signal indicating one vertical period from the scanning line P1, which is a first scanning line, and a horizontal synchronizing signal each indicating one horizontal period from the scanning line P2, which is a second scanning line, to the pixel circuit 63.

Furthermore, the display apparatus is provided with an on-and-off control line drive circuit 64 for supplying an on-and-off control signal to the pixel circuit 63 through on-and-off control line P3. The pixel circuit 63 controls the current to be flown to the pixel according to the value of control current Idata. Each of the pixel circuits 13 includes an organic EL device and its drive circuit.

The on-and-off control line P3 for each row includes three lines respectively for red, blue, and green color pixels, in each row. As the pixel circuits (pixels) 63, the pixel circuits 63 each including a light emitting device emitting one of the lights of the red, blue, and green colors are arranged in the row directions in order, and the group of the pixel circuits 63 of the three colors are repeatedly arranged. The configuration of each of the pixel circuits 63 including an organic EL device is similar to that of FIG. 2, and the operation of the pixel circuit is also similar to that of FIG. 2.

Figure 8:
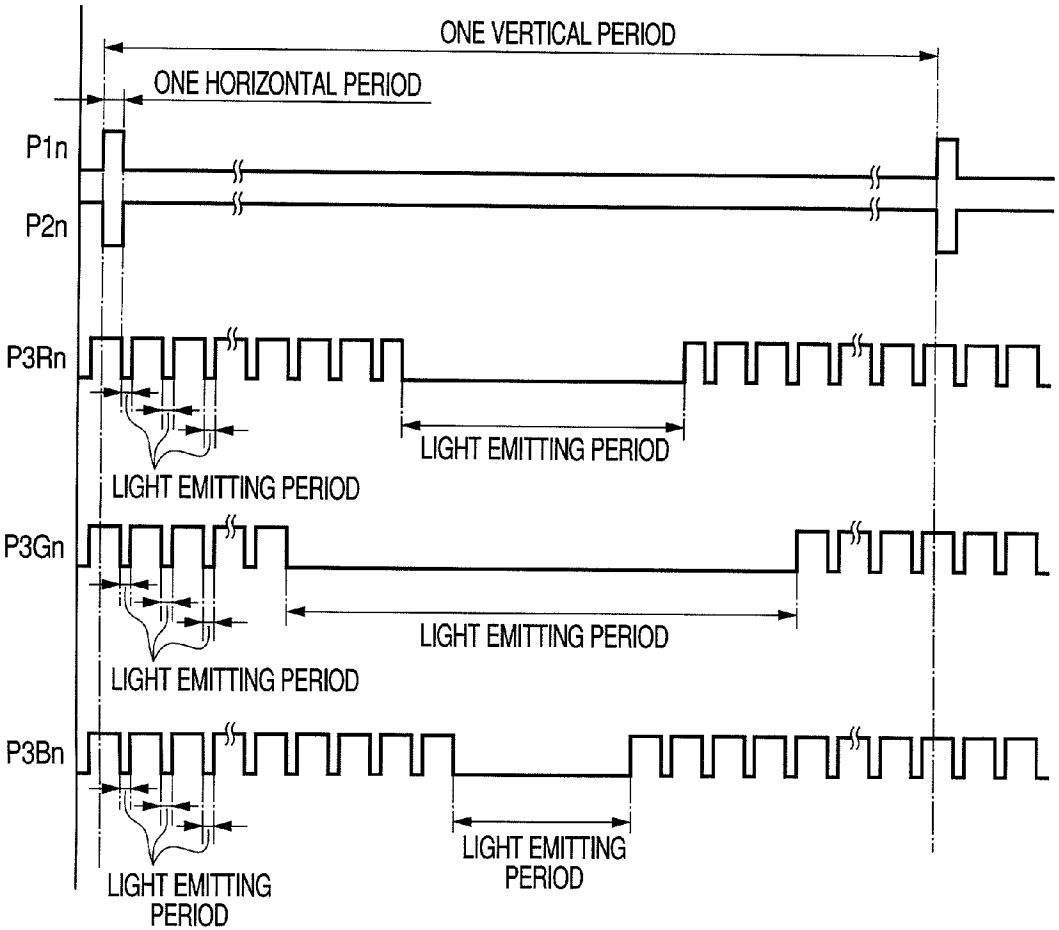
FIG. 8 is a signal waveform diagram illustrating a signal waveform and a light-emitting state of each portion of the second embodiment.

Next, the operation of the whole display apparatus is described. FIG. 8 illustrates a timing chart of each signal line. Information current is written into a pixel group connected to one scanning line in a lump during one horizontal period in the present embodiment.

Similarly, the information currents are sequentially written into the group of pixels connected to the scanning line on the next row in a lump, and the writing of the information currents into all of the pixels is completed during one vertical period (16.67 msec: equivalent to 60 Hz). A signal of a scanning line P1*n* illustrated in FIG. 8 is a vertical synchronizing signal indicating one vertical period, and a signal of a scanning line P2*n* in FIG. 8 is a horizontal synchronizing signal.

Now, as shown in FIG. 8, scanning lines P1 and P2 connected to the pixel circuits 63 of a n-th row in the display panel are denoted by P1*n* and P2*n*, respectively. Moreover, differently from the first embodiment, the on-and-off control lines P3 are wired to each of the pixels of the red, green, and blue colors independently, and are denoted by P3Rn, P3Gn, and P3Bn, respectively. As the pixel circuits 63, the pixel circuits respectively including the organic EL devices emitting red, green, and blue lights are arranged in the row directions in order, as described above. The configuration of each of the pixel circuits 63 is similar to that of FIG. 2, and the writing operation into each pixel circuit and the light emitting operation of the pixel circuit are also similar to those of the first embodiment.

Figure 9:
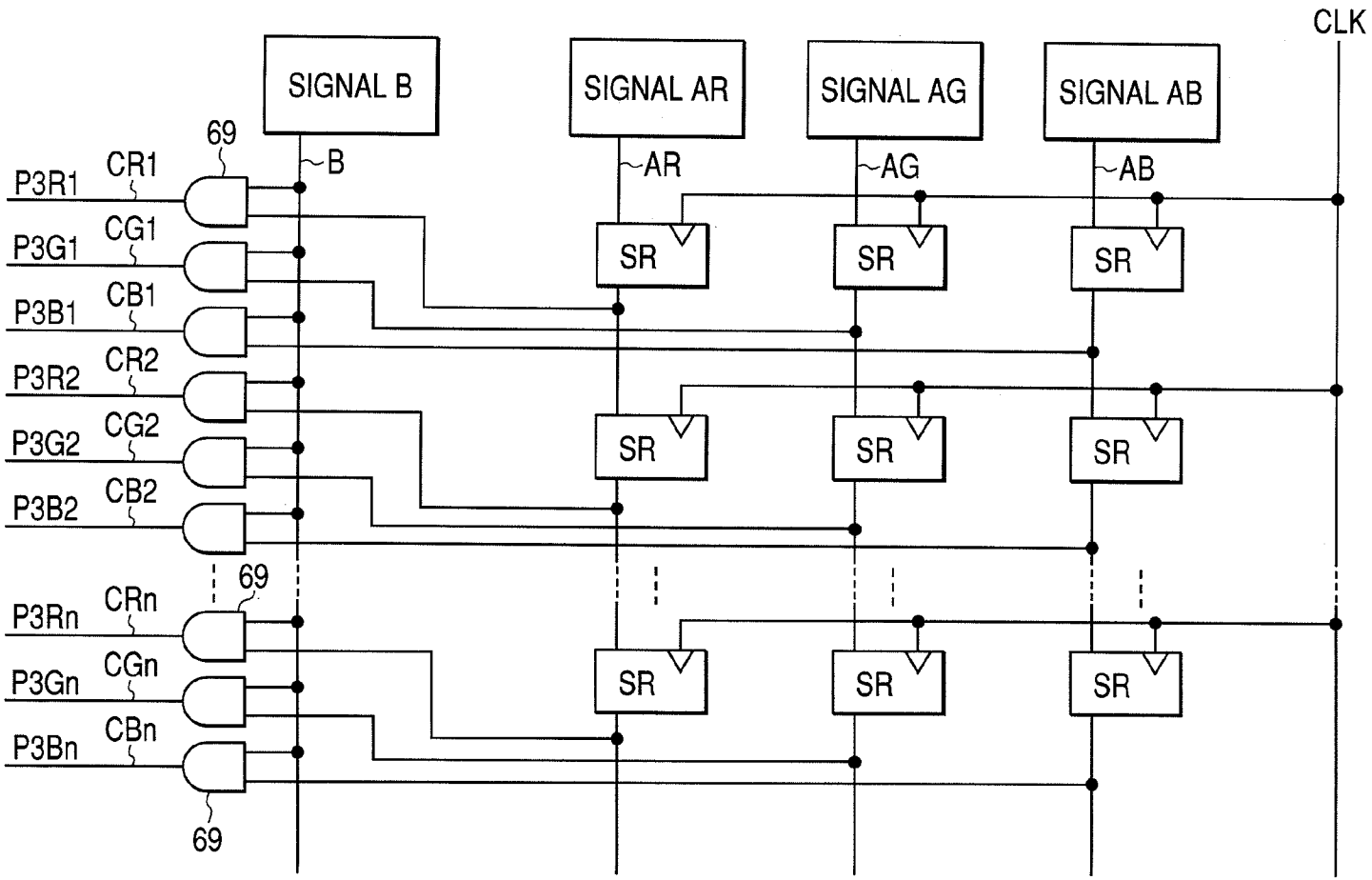
FIG. 9 is a block diagram illustrating an example of an on-and-off control line drive circuit of the second embodiment.
Figure 10:
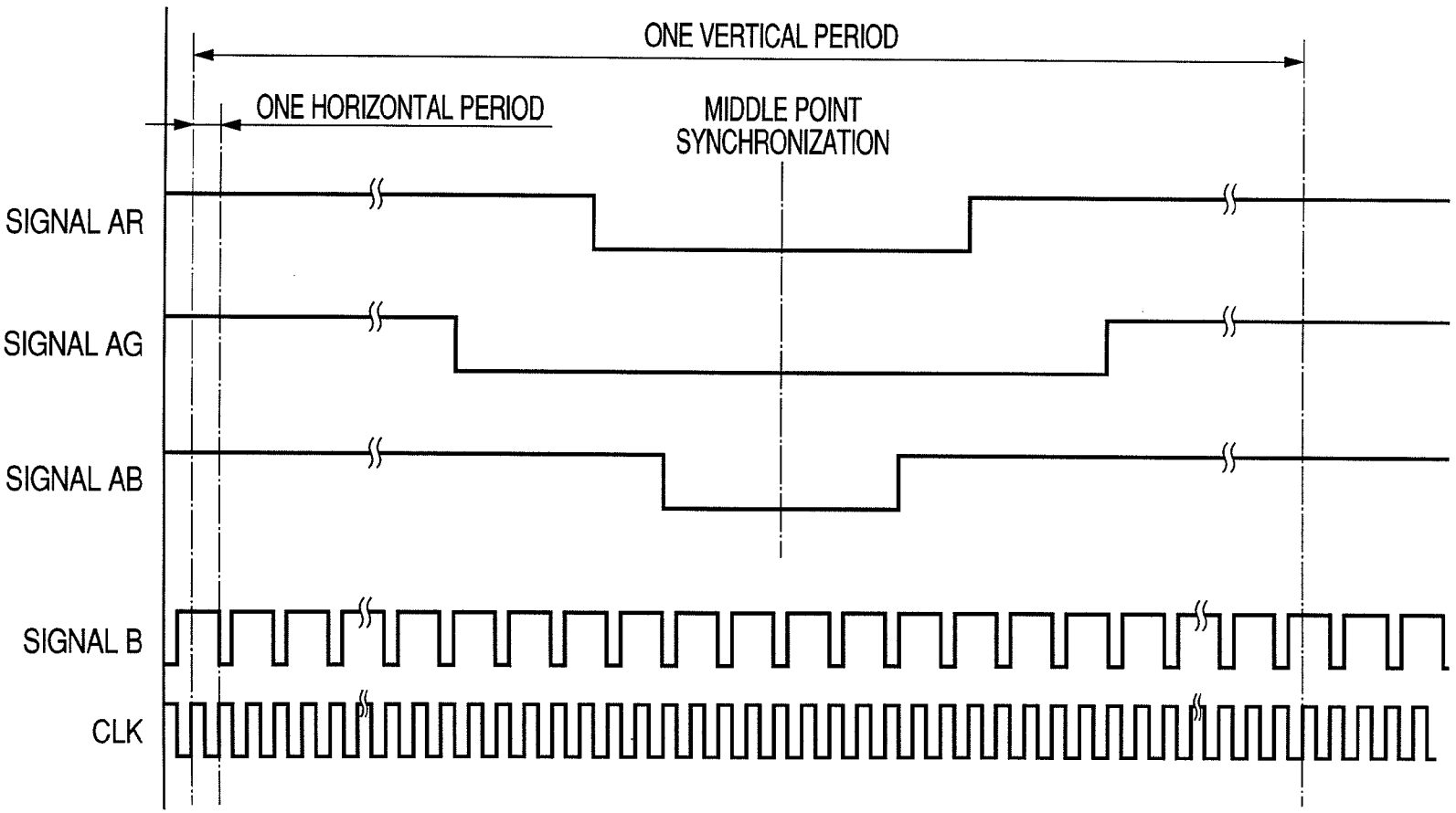
FIG. 10 is a diagram illustrating a signal of each portion of the on-and-off control line drive circuit of FIG. 9.

Next, signals CRn, CGn, and CBn to be supplied to the on-and-off control lines P3Rn, P3Gn, and P3Bn will be described. FIG. 9 is an internal block diagram of the on-and-off control line drive circuit 64, and FIG. 10 illustrates the signal waveform of each portion of the on-and-off control line drive circuit 64.

A signal AR, a signal AG, and a signal AB, which are first signals, are transmitted from a not-illustrated signal generating circuit. Each of the signals AR, AG, and AB has the same frequency as that of the vertical synchronizing signal. A signal B, which is a second signal, is similarly transmitted from the not-illustrated signal generating circuit. The signal B has a frequency of 20 times as those of the signals AR, AG, and AB in the example illustrated in FIG. 10, and it is better to set the frequency of the signal B to be twice or more as large as those of the signals AR, AG, and AB in order to decrease a flicker.

The signal B is output to one input terminal of each of a plurality of AND gates 69. Three AND gates 69 constitute one set, and the signal AR is input into the other input terminal of the AND gate 69 situated at the uppermost position in FIG. 9 through a shift register SR.

The signal AG is input into the other input terminal of a second AND gate 69 through a shift register SR, and the signal AB is input into the other input terminal of a third AND gate 69 through a shift register SR. The clock signal CLK of FIG. 10 is supplied to the respective shift registers SR. The clock signal CLK is set to have a frequency being twice or more as much as that of the signal B.

As a result, a composite signal CR1, which is the logical sum of the signal B, which is the second signal, and the signal AR, which is the first signal, is output from the AND gate 69 at the uppermost position, and a composite signal CG1, which is the logical sum of the signal B and the signal AG, is output from the second AND gate 69. Moreover, a composite signal CB1, which is the logical sum of the signal B and the signal AB, is output from the third AND gate 69.

After that, similarly, the composite signal of the logical sum of the signal B and the signal AR, the composite signal of the logical sum of the signal B and the signal AG, and the composite signal of the logical sum of the signal B and the signal AB are sequentially generated from a fourth AND gate 18 and the following ones through the shift registers SR, and the generated composite signals are output to each row in the display region. The composite signals CR, CG, and CB of the on-and-off control signals are output in such a way.

The signal on the on-and-off control line P3Rn illustrated in FIG. 8 corresponds to the composite signal CRn of FIG. 9; the signal on the on-and-off control line P3Gn illustrated in FIG. 8 corresponds to the composite signal CGn of FIG. 9; and the signal on the on-and-off control line P3Bn illustrated in FIG. 8 corresponds to the composite signal CBn of FIG. 9. The on-and-off control signals are supplied from the on-and-off control line drive circuit 64 of FIG. 7 to each pixel circuit through the on-and-off control lines P3, as described above, and writing is sequentially performed every row on one horizontal period basis.

The signals AR, AG, and AB, which are the first signals, are used for controlling the light emission balance of a red color, a green color, and a blue color, respectively. The present embodiment adjusts brightness by changing the rate of the light emitting period, that is, the duty ratio, in one vertical period so that a white color may be correctly displayed when all of the three colors emit lights at the brightness of 100%.

At the time of controlling the light emission balance, the waveforms of signals AR, AG, and AB are formed so that the middle time point between the trailing edge point and the leading edge point of the pulse taking charge of light emission (LOW level) of each of the signals AR, AG, and AB may be situated at the same timing as illustrated in FIG. 10. Consequently, the central times of the pulses originated in the signals AR, AG, and AB of the on-and-off control lines PRn, PGn, and PBn, respectively, illustrated in FIG. 8, accord with one another to be equal at the same timing. The color breakup at the edge portion can be thereby suppressed.

In FIGS. 8 and 10, the signals AR, AG, and AB, which are the first signals, are synchronized with the vertical synchronizing signal here. The information writing timing into a pixel and the light emitting timing of the organic EL device in the pixel can be thereby shifted, so that a uniform image quality in the display panel surface can be attained. The signal B of the second signal is similarly synchronized with the vertical synchronizing signal, and the information writing timing into a pixel and the light emitting timing of the organic EL device in the pixel can be thereby shifted, so that a uniform image quality in the display panel surface can be obtained.

Figure 11A:
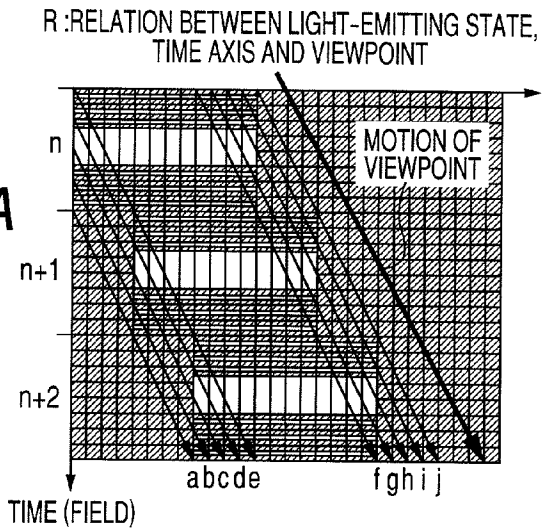
FIGS. 11A, 11B, 11C, and 11D are diagrams illustrating light-emitting states and an apparent image of the second embodiment.
Figure 11B:
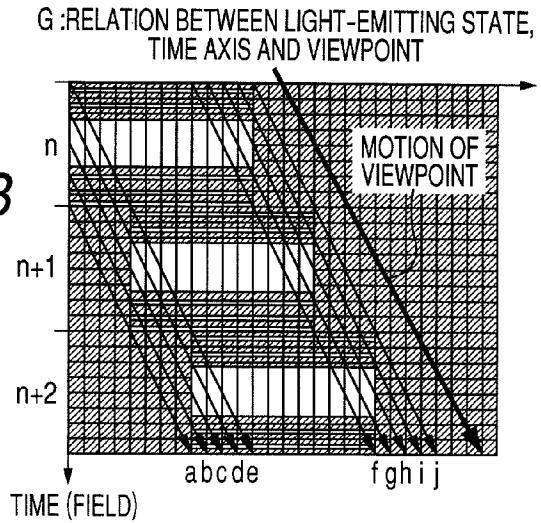
Figure 11C:
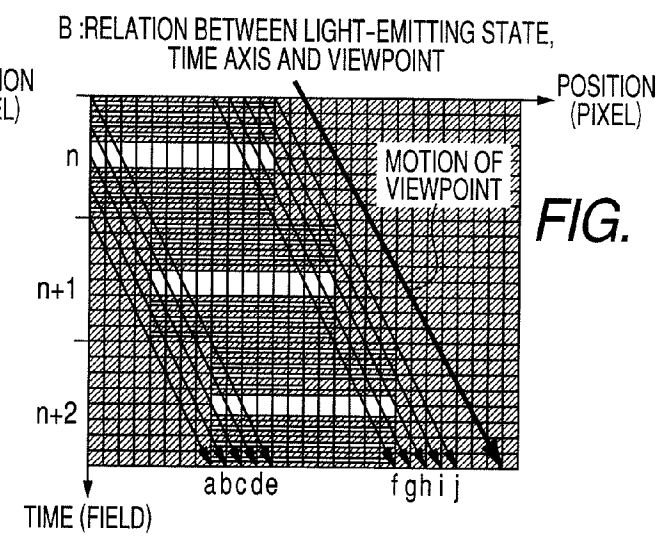
Figure 11D:
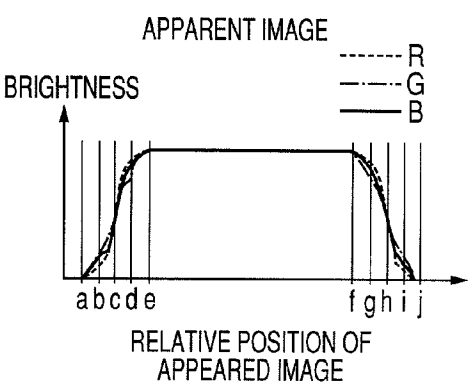
Figure 12:
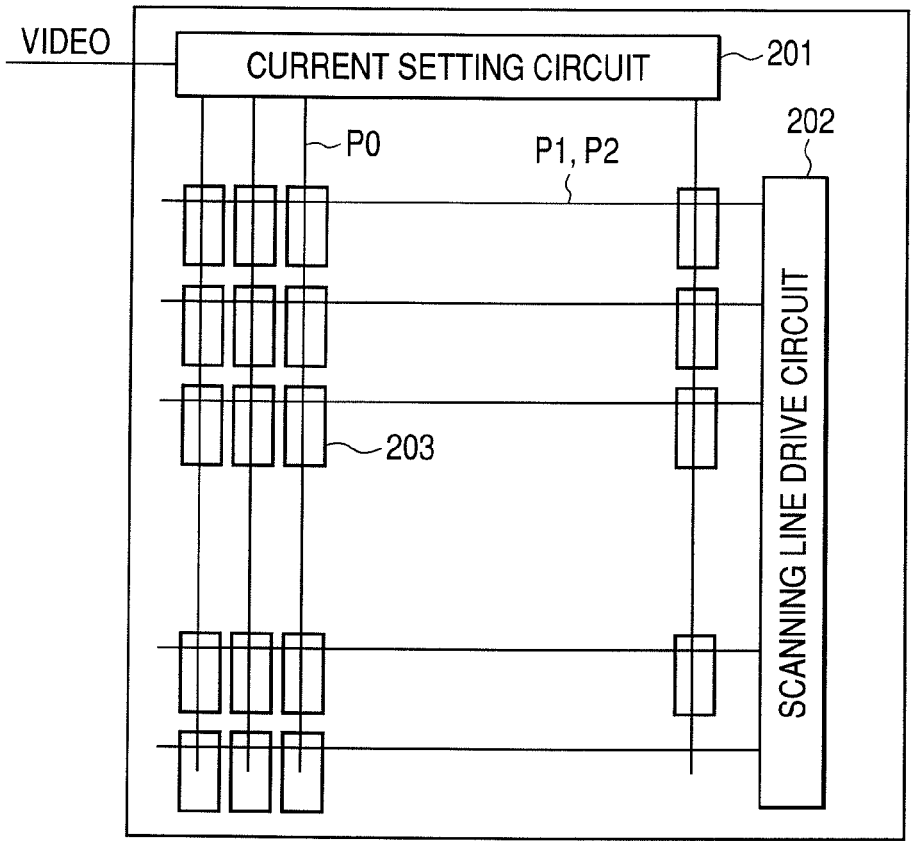
FIG. 12 is a schematic diagram illustrating a related art display apparatus.
Figure 13:
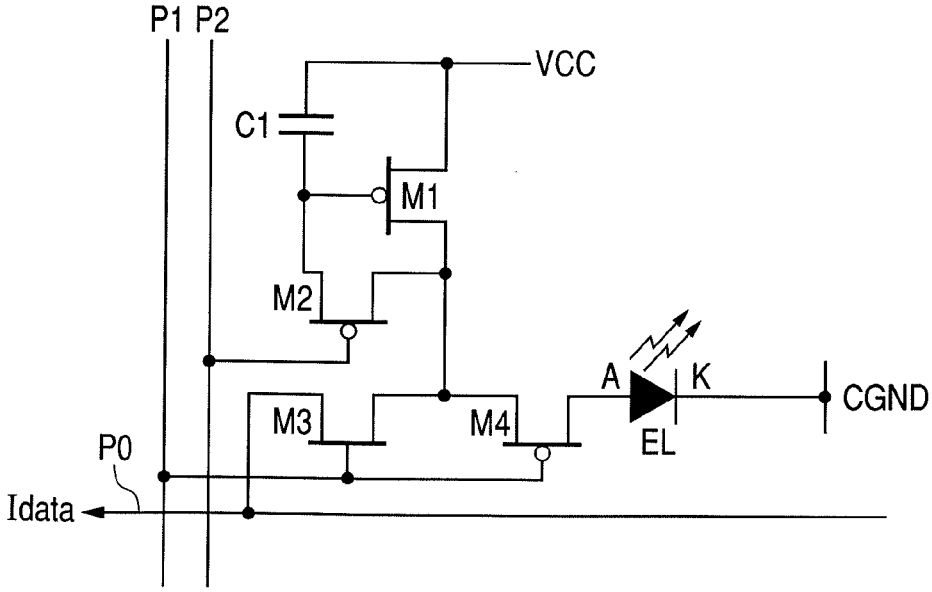
FIG. 13 is a circuit diagram illustrating a pixel circuit of the related art.
Figure 14A:
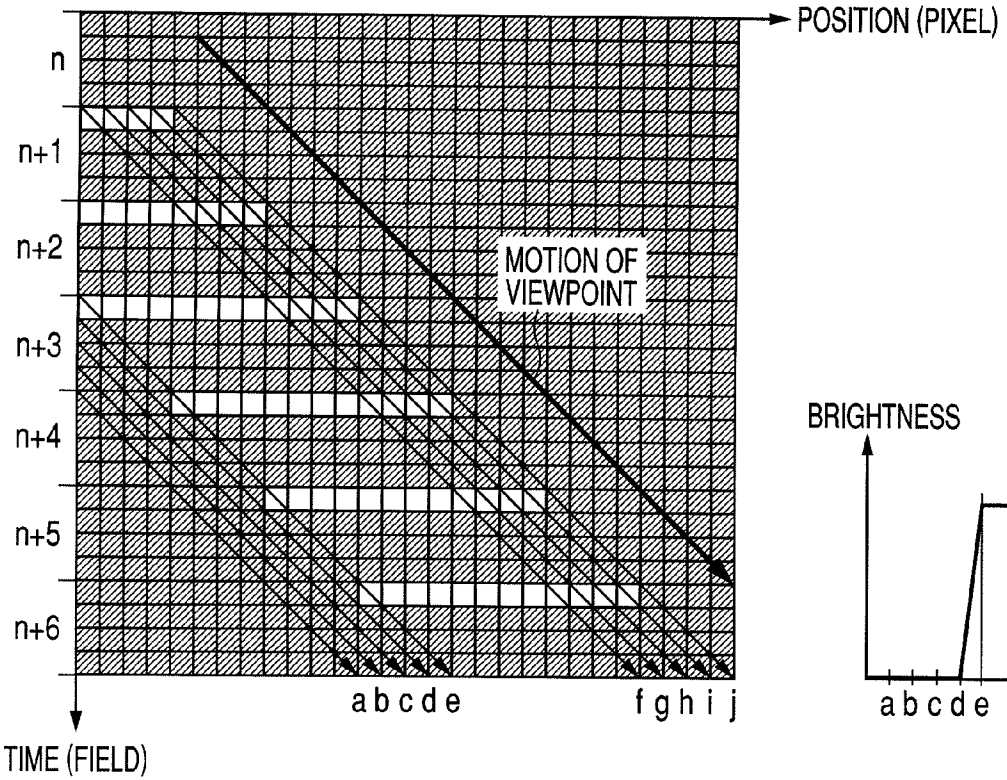
FIGS. 14A and 14B are diagrams showing an impulse type moving image displaying state and an apparent image, respectively.
Figure 14B:
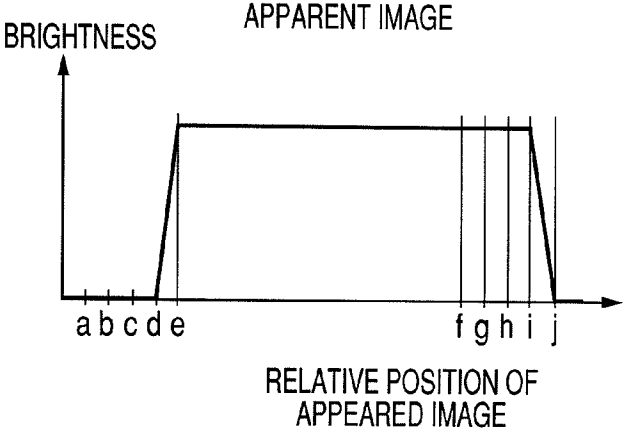

In the present embodiment, a moving object (a white object in a black background) is displayed with the display apparatus described above. The moving image displaying states and apparent images of the present embodiment are illustrated in FIGS. 11A-11C, and 11D, respectively. That is, FIG. 11A illustrates a moving image displaying state of a red (R) color; FIG. 11B illustrates a moving image displaying state of a green (G) color; FIG. 11C illustrates a moving image displaying state of a blue (B) color; and FIG. 11D illustrates the apparent image of each of the red, green, and blue colors.

As illustrated in FIGS. 11A-11C, when an object moves on a screen, a viewpoint also continuously moves, following the movement of the object. At that time, apparent brightness recognized as visual information is an integrated quantity of the brightness at each position in the field of vision.

At this time, the apparent images become the ones illustrated in FIG. 11D. The edges of the apparent images are seen to be conspicuous in comparison with the edge of the hold type display illustrated in FIGS. 15A and 15B and the edge of the high frequency on-and-off type display illustrated in FIGS. 16A and 16B. Moreover, because the organic EL devices are turned on and off on the basis of the high frequency signal B, the decrease of a flicker also can be attained. Furthermore, because the centers between the rise timing and the trailing edge of the red color, the green color, and the blue color are equal as described above, the occurrence of color bleeding at an edge portion can be decreased.

It is possible to decrease a flicker with the resolution of a moving image being heightened in the way described above. Moreover, it is also possible to decrease the occurrence of color bleeding at the edge portion at the time of a moving image display with the brightness balance of red, green, and blue controlled based on a light emitting period.

Incidentally, although the description has been given to the example of the display apparatus using the organic EL devices in the above embodiments, the display apparatus of the present invention is not limited to this one type. As long as a display apparatus is a self-light-emitting type, the present invention can be suitably applied to the display apparatus. Moreover, although the description has been given to the pixel circuits controlling gradations based on the current signals, the pixel circuits of present invention is not limited to the described ones. The present invention can be also suitably applied to a display apparatus including pixel circuits controlling gradations based on voltage signals.

While the present invention has been described with reference to exemplary embodiments, it is to be understood that the present invention is not limited to the disclosed exemplary embodiments. The scope of the following claims is to be accorded the broadest interpretation so as to encompass all such modifications and equivalent structures and functions.

This application claims priority from Japanese Patent Application No. 2007-060278 filed on Mar. 9, 2007, which is hereby incorporated by reference herein.

What is claimed is:

1. A display apparatus comprising:

a plurality of pixel circuits arranged in a matrix form, each including a light emitting device;

a plurality of information lines, each connecting a pixel circuit in a column of the matrix form;

an information line drive circuit, which supplies information signals to the plurality of information lines;

a plurality of scanning lines, each connecting a pixel circuit in a row of the matrix form;

a scanning line drive circuit, which sequentially supplies scanning signals to the plurality of scanning lines in one vertical period;

a plurality of on-and-off control lines, each controlling turning-on and turning-off of the light emitting devices in a row of the matrix form; and an on-and-off control line drive circuit, which supplies on-and-off control signals to the plurality of on-and-off control lines, wherein in each vertical period, the information line drive circuit and the scanning line drive circuit supply the information signal once to each of the pixel circuits, wherein the on-and-off control line drive circuit supplies composite signals, each provided by synthesizing a first signal and a second signal, to the respective on-and-off control lines as on-and-off control signals, the first signal having a frequency corresponding to the vertical period, and the second signal having a frequency being twice or more as large as that of the first signal, and wherein each of the plurality of pixel circuits supplies a current corresponding to the supplied information signal and the on-and-off control signals to the light emitting device, and thereby the light emitting device emits light such that in each vertical period, the light emitting device has a first light emitting period during which light is emitted based on the frequency of the first signal and a second light emitting period during which light is emitted based on the frequency of the second signal, wherein the first light emitting period has the same period of the first signal and the second light emitting period has the same period of the second signal.

2. The display apparatus according to claim 1, wherein the on-and-off control signal is generated from the composite signal of the first signal having different timing for every row and the second signal.

3. The display apparatus according to claim 1, wherein the on-and-off control signal is generated from the composite signal of the first signal and the second signal, the composite signal having different timing for every row.

4. The display apparatus according to claim 1, wherein the light emitting device is an organic EL device.

* * * * *